US005158129A

United States Patent [19]

Hubert et al.

[11] Patent Number: 5,158,129

[45] Date of Patent: Oct. 27, 1992

[54] METHOD AND DEVICE FOR FEEDING A POWDERED OR GRANULAR MATERIAL INTO A CONTINUOUS CASTING MOLD

[75] Inventors: Ghislain Hubert, Terville; André Klein, Homecourt; Patrick Ominetti, Thionville; Raymond Pilloy, Kanfen, all of France

[73] Assignees: Sollac, Puteaux; Techmetal Promotion, Maizieres-les-Metz, France

[21] Appl. No.: 748,930

[22] Filed: Aug. 23, 1991

[30] Foreign Application Priority Data

Aug. 27, 1990 [FR] France ..... 90 10756

[51] Int. Cl.[5] ..... B22D 11/16

[52] U.S. Cl. ..... 164/452; 164/154

[58] Field of Search ..... 164/4.1, 451, 452, 150, 164/154, 155, 473

[56] References Cited

U.S. PATENT DOCUMENTS 3,439,759 4/1969 Rouanet et al. ..... 164/155
3,654,970 4/1972 Teboul ..... 164/155

FOREIGN PATENT DOCUMENTS 2816867 10/1978 Fed. Rep. of Germany .
3031503 9/1981 Fed. Rep. of Germany .
2407773 6/1979 France .
2635029 2/1990 France .
0123555 5/1988 Japan ..... 164/154
1235624 11/1984 U.S.S.R. ..... 164/154
2024029 1/1980 United Kingdom .
2116092 9/1983 United Kingdom .

*Primary Examiner*—Richard K. Seidel
*Assistant Examiner*—Erik R. Puknys
*Attorney, Agent, or Firm*—Cushman, Darby & Cushman

[57] ABSTRACT

A system with a principal hopper having balances and discharge piping fitted with a valve and a flow sensor. The lower end of the piping extends into a secondary hopper which is connected to a pipe fitting powder to an ingot mold. The powder flows from the principal hopper into the secondary hopper and flows through the pipe into the ingot mould where it spreads over a cast metal surface. When the level of powder in the secondary hopper reaches the lower end of the piping, the flow is terminated and the flow sensor initiates valve closure. The valve is reopened after a specified time period or when another sensor indicates the absence of powder. In this way, it is possible to determine powder consumption by measuring the time between two successive valve openings or closures.

9 Claims, 1 Drawing Sheet

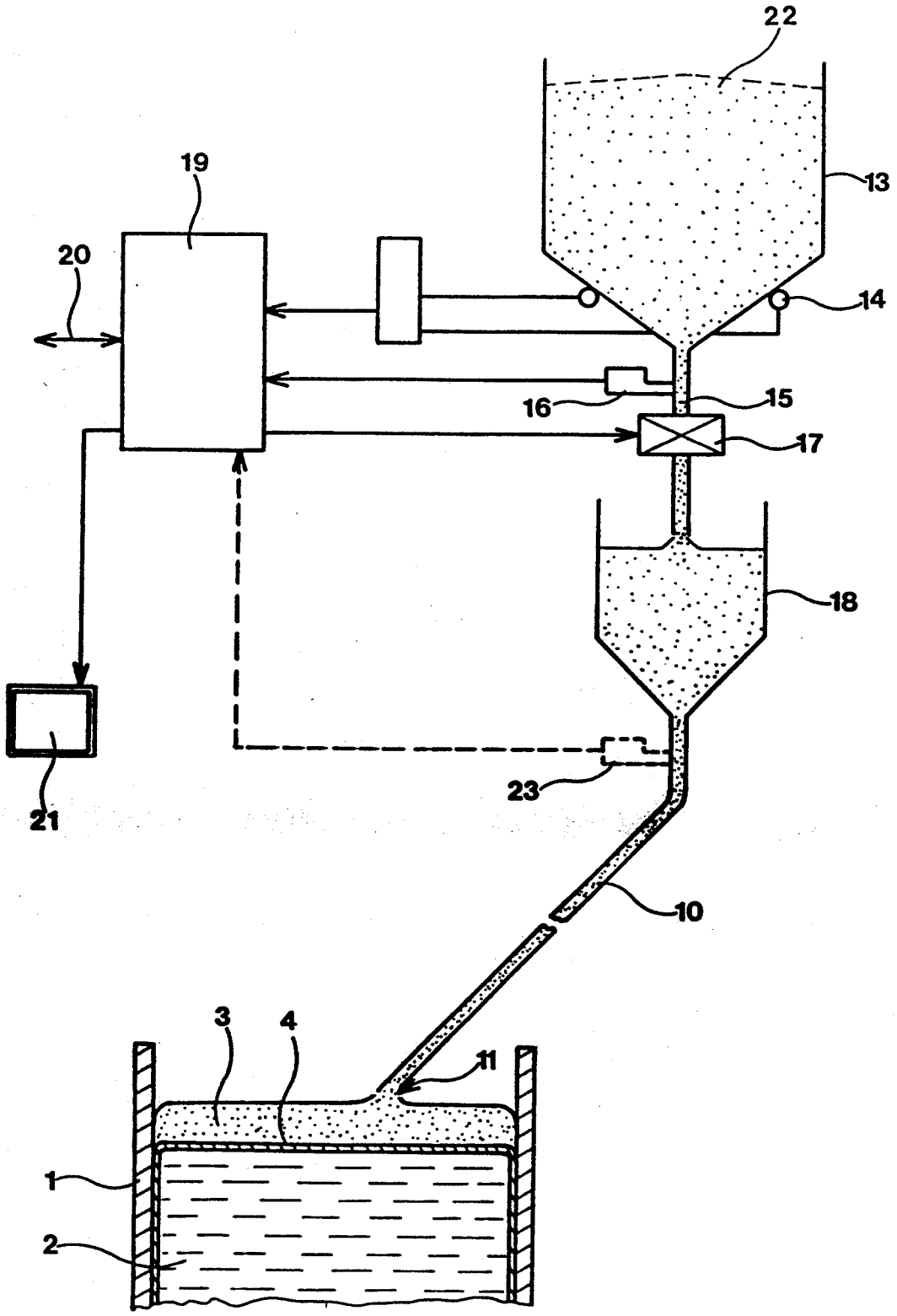
22
19
13
20
14
16
15
17
18
21
23
10
3
4
11
1
2

METHOD AND DEVICE FOR FEEDING A POWDERED OR GRANULAR MATERIAL INTO A CONTINUOUS CASTING MOLD

The present invention relates to the continuous casting of metals and, in particular, steel.

More precisely, the invention relates to feeding and depositing a layer of a powdered or granular material on surface of the liquid metal in a continuous casting mould, this material thermally insulate the bath of molten metal, avoid reoxidation of the metal and ensure the lubrication of the walls of the mold. For the sake of convenience, this material will be termed hereinafter a "powder", it being understood that its particle size and the form of the particles may vary widely. This powder is liquified upon contact with the liquid metal and infiltrates between the metal and the walls of the ingot mold and thus performs a lubricating function. There results a continuous consumption of powder during the casting which must be compensated for by a feeding of this powder which varies as a function of the characteristics of the powder, the casting installation and the cast metal. Further, the consumption of powder may vary in the course of casting as a function of the different parameters of the method and in particular of the temperature of the cast metal.

In order to ensure a constant level of powder and therefore the regularity of the thickness of the layer of the latter, it is known to effect the feeding of the powder by gravity through a pipe leading from a hopper containing said material and placed above the mold, this pipe opening into the mold above the surface of the cast metal at a distance from the latter corresponding to the desired thickness of the powder in the solid or molten state. Such a device is in particular disclosed in the document FR-A-2522551, the teaching of which is included herein by reference.

This device affords an automatic feeding of the powder owing to the fact that, when the thickness of the latter tends to diminish, the powder flows through the pipe under the effect of gravity until the upper level of the layer reaches the level of the discharge orifice of the pipe and thus stops the flow. Advantage is therefore taken, for the purpose of automatically controlling the feeding of the powder, of the facility of the powder to spread substantially uniformly throughout the section of the ingot mold, while benefitting from the characteristics of particulate materials which are deposited as a heap at the outlet end of the feed pipe.

This system provides knowledge of the mean consumption of powder, for example for one casting, by measuring the quantity of powder introduced into the feed hopper. On the other hand, the instantaneous consumption, or the consumption over short periods, cannot be determined.

An object of the invention is to solve this problem and therefore to know the instantaneous consumption of powder so as to relate this consumption to the instantaneous casting conditions, such as the rate of extraction, temperature of the casting, nature of the powder, frequency and amplitude of the reciprocations of the mold, and the parameters specific to each casting, such as the shape of the cast product, nature of the metal, etc.

With these objects in mind, the invention provides a feed device for depositing a layer of a powdered or granular material on the surface of a liquid metal contained in a continuous casting mold, comprising a feed pipe having a permanently open lower discharge end located above said surface of the metal at a height equal to, or slightly greater than, a required thickness of the layer of said material, and means for permanently feeding said material in said pipe.

According to the invention, this device is characterized in that it comprises an upper principal hopper provided with discharge piping having a lower end which extends into, without being rigidly connected to, a lower secondary hopper which opens into the feed pipe, a closing valve and a sensor of the flow of the material which are placed on the discharge piping, means for controlling the valve as a function of indications delivered by the flow sensor, means for weighing the upper hopper, and calculating means for determining the flow of the material as a function of the time elapsed between two successive closures or openings of the valve, and of the quantity of the material flowing from the upper hopper into the lower hopper.

The invention also provides a method for feeding and depositing a layer of a powdered or granular material on the surface of a liquid metal contained in a continuous casting ingot mold in the course of the casting, employing the device described hereinbefore, positioning the lower end of the feed pipe above the surface of the metal at a height equal to, or slightly greater than, a required thickness of the layer of said material, filling the upper hopper with said material, and, for the purpose of permanently measuring the consumption of said material when casting said metal, closing the valve each time the flow sensor indicates zero flow, recording the time t at each closure or opening and, after each closure of the valve, weighing the upper hopper and recording the value of the measured weight and deducing therefrom the consumption of material during each lapse of time between two successive closures or openings of the valve.

According to a first embodiment, the valve is opened at the end of a predetermined period after the closure of the valve. It is then possible to determine the consumption of material throughout the casting, at intervals of time which are predetermined and constant or variable as a function of the evolution of the casting.

According to a second embodiment, there is employed a sensor of the presence of the material in the lower hopper located at a predetermined distance below the end of the discharge piping, and the valve is opened when this sensor indicates an absence of material, i.e., that the lower hopper is emptied down to the level of the sensor detecting the presence of the material. It is then possible to represent the consumption as the series of periods of variable durations corresponding to the time required to consume a substantially constant quantity of material.

Further features and advantages of the invention will be apparent from the following description, given by way of example, of two embodiments of a device for feeding a covering powder to a continuous casting installation, and the methods for using these devices in accordance with the invention.

Reference will be made to the accompanying drawing the single Figure of which is a diagrammatic view of the device.

This Figure shows a continuous casting mold with liquid metal 2 in the conventional manner by feed means (not shown). Located above the metal is a layer of covering powder 3 which melts upon contact with the metal and forms a liquid film 4 of slag which gradually flows toward the walls of the mould and infiltrates between these walls and the metal where it performs the function of a lubricant. There is consequently a continuous consumption of powder during the casting which must be permanently replenished in order to ensure a substantially constant thickness of the layer of powder 3.

The powder is fed through a feed pipe 10 which opens out through its lower permanently open end 11 above the surface of the metal at a height equal to, or slightly greater than, a required or set thickness of the layer of powder and slag. As this pipe is permanently fed with powder, the latter is poured into the mold until the layer thus formed comes to close the orifice 11 and thus stops the feeding of powder. This principle of feeding and regulating the thickness of the layer of powder is disclosed in detail in the aforementioned document FR-A-2522551 to which reference may be made for further information.

As already mentioned, the object of the invention is to substantially instantaneously measure the consumption of powder relative to the duration of a casting. For this purpose, the device comprises a principal hopper 13 provided with weight indicators 14. This principal hopper carries in the lower part thereof discharge piping 15 on which is placed a flow sensor 16 and a valve 17 below the latter.

The lower end of the piping 15 extends into, without being rigidly fixed to, a secondary hopper 18 of smaller capacity, the outlet orifice of which is connected to the feed pipe 10.

The weight indicators 14, the flow sensor 16, and the valve 17 are connected to a monitoring and control unit 19 which is connected through a connection 20 to a processing computer of the installation (not shown) and to display or graphical representation means 21.

The operation of this device during casting will now be described.

With the principal hopper 13 filled with powder 22 and the valve 17 open, the powder flows into the secondary hopper 18 and is then conducted through the feed pipe 10 into the mold where it spreads over the surface of the metal 2 until the layer of powder 3 reaches substantially the level of the end orifice 11 of the pipe 10 and stops the flow, as explained hereinbefore.

The powder then fills the pipe 10 and then the secondary hopper 18 until the level of the powder in the latter reaches the lower end of the piping 15 and stops the flow in this piping in a manner similar to that occurring in the mold. The flow sensor 16 reacts to this zero flow and delivers a signal to the control unit 19 which closes the valve 17. This is the state shown in the accompanying drawing.

The device can then operate in two different ways corresponding respectively to the two aforementioned embodiments.

According to the first embodiment, the valve 17 is opened at the end of a predetermined period of time after the closure thereof.

Owing to the consumption of powder in the mold, the level of the powder in the latter drops and consequently allows the flow of the powder contained in the pipe 10 and the hopper 18. As the level of the powder drops in this hopper 18 it opens the lower orifice of the piping 15 and the part of the latter located below the valve 17 is emptied. At the end of a certain period of time, depending on the consumption in the mold but usually rather short, owing to the fact that the internal volume of the part of the piping 15 located below the valve 17 is preferably arranged to be as small as possible, there is no longer any interaction between the principal hopper and the secondary hopper; the weighing of the principal hopper is then effected by the weight indicators 14 and the value of the measured weight is recorded.

After a lapse of time predetermined as a function of the estimated consumption of powder and the precision of the desired measurements, the valve 17 is opened, the powder once again flows in the piping 15 and fills the secondary hopper 18 until a new stoppage of the flow, the procedure being thereafter repeated in a similar manner.

It will easily be understood that the flow or consumption of powder may then be easily calculated from the duration between two successive closures or openings of the valve and the difference between two corresponding successive weighings, this calculation being effected by the monitoring and control apparatus and/or the processing computer unit of the casting and the results being represented by the display device 21, for example, in the form of a curve of consumption as a function of time.

Note that, in order to avoid fixing a delay between the moment of the closure of the valve and the weighing, the latter may be validated only just before the following opening.

The shorter the lapse of time between the closure and opening of the valve, the more the determined consumption will be really "instantaneous". However, if this lapse of time is very short, the difference between the weighings is liable to be small and the precision of the weighings correspondingly lower. Further, this duration must be short enough to ensure, bearing in mind the capacity of the secondary hopper, that the latter and the feed pipe do not become completely emptied.

Note moreover that, if it is desired that the measurements of consumption of powder intervene in the conducting of the casting process, the duration of the closure will be preferably short in order to have a reaction time in the process which is as short as possible, bearing in mind, of course, that the consumption at a given instant can only be evaluated at the end of the cycle of operation of the device, i.e., practically only when the valve 17 is opened for completing the secondary hopper.

In the second embodiment, the device further comprises a sensor 23 of the presence of powder placed on the secondary hopper or on the feed pipe and also connected to the control unit 19. In this case, the valve 17 is opened when the presence sensor 23 delivers the signal of absence of powder.

The device then operates in the following manner, starting at the stage represented in the drawing.

Owing to consumption in the mold, the level of the powder in the secondary hopper drops until it arrives at the level of the presence sensor 23 which then delivers to the control unit 19 a signal indicating the absence of powder which in turn results in the opening of the valve 17. The powder then fills the secondary hopper 18 up to the level of the lower end of the piping 15, whereupon flow in the latter stops. The flow sensor 16 then reacts and closes the valve.

In other words, in this type of operation, the quantity of powder consumed for each cycle is substantially constant, since it corresponds to the volume of the hopper 18 and piping between the presence sensor 23 and the valve 17, to within the quantity of powder consumed between the moment of the sensing of the absence of powder by the sensor 23 and the end of the filling of the secondary hopper. On the other hand, the duration between two successive openings or closures of the valve varies as a function of the consumption in the mold.

Further, the presence sensor 23 will be positioned to be sufficiently remote in the upstream direction from the end 11 of the pipe 10 to avoid, in the event of a large consumption, a stoppage of the feeding of powder into the mold which might be due to a possible delay in the flow of powder between the sensing of the absence of powder and the arrival of powder in this pipe.

Note that, in the case of small consumption and for given secondary hopper capacities, in the first embodiment, the duration of each cycle may be short and a consumption value will be very rapidly obtained, whereas, in the second embodiment, the duration of the cycle will be long. Consequently, a secondary hopper of small capacity will be preferably chosen in this case to reduce this time.

Note also that in both cases, a failure of the monitoring or control system for the valve 17 may be overcome with no adverse effect on the casting as concerns the maintenance of the desired layer of powder in the mold other than the lack of measurement of the consumption, by for example manually opening the valve 17 and maintaining this valve open. Indeed, as the regulation of the level of the powder in the secondary hopper 18 is automatically achieved in a manner similar to the regulation of the level of the powder in the ingot mold, the feeding of the powder will be pursued in a continuous manner without risk of an overflow from the secondary hopper.

In the second embodiment, the presence sensor 23 could also be placed directly on the hopper 18 without modifying the principle of operation of the device.

The secondary hopper may also be formed by the upper end of the feed pipe which will then be sufficiently enlarged to allow insertion of the lower end of the piping 15.

What is claimed is:

1. A feed device for deposing a layer of a powdered or granular matérial on a surface of a liquid metal in a continuous casting mold, said device comprising:

a feed pipe having a lower permanently open discharge end for positioning above said surface of said metal at a height between a value equal to, and a value slightly greater than, a require thickness of said layer of said material;

a hopper assembly comprising an upper principal hopper and a lower secondary hopper, said principal hopper having discharge piping having a lower end which extends into, without being rigidly connected to, said lower secondary hopper, said secondary hopper opening into said feed pipe, a closing valve located on said discharge piping;

a flow sensor for said material, located on said discharge piping;

means for controlling said valve as a function of indications delivered by said flow sensor;

means for weighting said upper hopper; and calculating means for determining the flow of said material as a function of time elapsed between two successive closures or openings of said valve, and of the quantity of material flowing from said upper hopper into said lower hopper.

2. A feed device according to claim 1, further comprising:

means for closing said valve when said flow sensor indicates a zero flow of said material.

3. A feed device according to claim 1, further comprising:

means for opening said valve at the end of a predetermined period of time after the closure of said valve.

4. A feed device according to claim 1, further comprising:

a sensor of the presence of said material located on said lower hopper at a predetermined distance below said lower end of said discharge piping; and means for opening said valve when said presence sensor indicates an absence of said material.

5. A feed device according to claim 1, further comprising:

a sensor of the presence of said material located on said feed pipe at a predetermined distance below said lower end of said discharge piping; and means for opening said valve when said presence sensor indicates an absence of said material.

6. A feed device according to claim 1, wherein said lower hopper comprises an upper end portion of said feed pipe.

7. A method for feeding and depositing a layer of powdered or granular material on a surface of a liquid metal in a continuous casting ingot mold during casting, said method employing a device comprising a feed pipe having a lower permanently open discharge end for positioning above said surface of said metal at a height between a value equal to and a value slightly greater than a required thickness of said layer of said material, a hopper assembly comprising an upper principal hopper and a lower secondary hopper, said principal hopper being provided with discharge piping having a lower end which extends into, without being rigidly connected to, said lower secondary hopper, said secondary hopper opening into said feed pipe, a closing valve and a flow sensor of said material both placed on said discharge piping, means for controlling said valve as a function of indications delivered by said flow sensor, means for weighting said upper hopper, calculating means for determining the flow of said material as a function of time elapsed between two successive closures or openings of said valve, and of the quantity of material flowing form said upper hopper into said lower hopper, said method comprising the steps of:

positioning said lower end of said feed pipe above the surface of said metal at a height between a value equal to and a value slightly greater than a required thickness of said layer of material;

filling said upper hopper with said material;

closing said valve each time said flow sensor indicates zero flow for the purpose of permanently measuring the consumption of said material int eh course of the casting of said metal;

recording a time t at each closure or opening; and weighing said upper hopper and recording the value of the measured weight after each closure of said valve; and calculating therefrom the consumption of material during each lapse of time between two successive closures of said valve.

8. A method according to claim 7, further comprising the step of:

opening said valve at the end of a predetermined period of time after the closure thereof.

9. A method according to claim 7, further comprising the step of:

opening said vale when a presence sensor indicates an absence of said material.

* * * * *